US007263853B2

(12) United States Patent
Zizas

(10) Patent No.: US 7,263,853 B2
(45) Date of Patent: Sep. 4, 2007

(54) MACHINE MOUNTING ADAPTER

(75) Inventor: Michael A Zizas, Bloomingdale, IL (US)

(73) Assignee: IMI Cornelius Inc., Glendale Heights, IL (US)

( * ) Notice: Subject to any disclaimer, the term of this patent is extended or adjusted under 35 U.S.C. 154(b) by 700 days.

(21) Appl. No.: 10/812,371

(22) Filed: Mar. 29, 2004

(65) Prior Publication Data

US 2004/0263036 A1 Dec. 30, 2004

Related U.S. Application Data

(60) Provisional application No. 60/460,480, filed on Apr. 4, 2003.

(51) Int. Cl.
*F25C 1/00* (2006.01)

(52) U.S. Cl. ..... 62/344; 62/298; 62/389; 248/346.07

(58) Field of Classification Search ..... 62/66–74, 62/298, 340–356, 389–400; 248/346.07
See application file for complete search history.

(56) References Cited

U.S. PATENT DOCUMENTS 6,203,031 B1 * 3/2001 Leverington ..... 280/35
6,820,850 B2 * 11/2004 Coleman ..... 248/346.07
6,880,358 B2 * 4/2005 Lucas et al. ..... 62/344
7,124,992 B1 * 10/2006 Colledge ..... 248/346.07
7,198,241 B1 * 4/2007 Helgenberg et al. ..... 248/298.1

* cited by examiner

*Primary Examiner*—William E. Tapolcai
(74) *Attorney, Agent, or Firm*—Pyle & Piontek, LLC

(57) ABSTRACT

A machine mounting adapter accommodates mounting of a variety of differently dimensioned machines on top of a standard sized base machine, and in particular enables any one of a number of differently sized ice machines to be mounted on top of a given ice dispenser. The adapter includes both a specially configured cover that replaces a standard cover normally found on the ice dispenser and a pair of rigid bars that together with the specially configured cover are supported on a top perimeter edge defined around an open upper end of an ice retaining bin of the ice dispenser. An ice machine mounts on top of the cover with an ice drop hole in the cover providing access for ice made by the ice machine to enter the bin. The pair of rigid bars are adapted to be positioned in selected and adjustably spaced relationships, in one embodiment on the cover and in another embodiment on the perimeter edge of the ice retaining bin, such that the bars are located generally beneath and along front and rear ends of any particular ice machine mounted on the cover in order to provide secure support for the ice machine on top of the ice dispenser. By virtue of the bars being adjustable in their spacing, the machine mounting adapter can accommodate mounting of various size ice machines on an ice dispenser of given size.

17 Claims, 5 Drawing Sheets

MACHINE MOUNTING ADAPTER

This application claims benefit of provisional application Ser. No. 60/460,480, filed Apr. 4, 2003.

BACKGROUND OF THE INVENTION

The present invention relates generally to assemblies for mounting one machine on top of another, and more specifically to assemblies that are adaptable in their ability to permit the mounting of variously dimensioned machines to a standard sized base machine.

It is often required that machines having differing functionalities be assembled together, resulting in a device having the combined abilities of both. Frequently, the machines that are so combined are not made by the same manufacturer and are not dimensioned to fit together properly. It therefore is often necessary to build specially designed adapting structures or mountings that accommodate differences in machine configurations to permit the securing together of two or more machines to form the desired functional whole. It is expensive and time consuming to be required to specially manufacture custom mounting hardware. It also is costly to be required to have an inventory of various mounting kits for each of a variety of possible machine configurations and combinations.

The above problem is illustrated specifically in the case of mounting an icemaker to the top of an ice and beverage dispensing machine. As is known, ice/beverage dispensing machines include ice retaining hoppers or bins having top ice loading openings. A top bin cover is used to cover the bin opening and is removable to permit manual filling of the ice bin with ice. Filling is typically accomplished by lifting and emptying individual buckets of ice into the bin until it is sufficiently full. To eliminate the difficulties associated with manually filling bins and to minimize the occasions when the bins may be emptied of ice, it has long been known to mount an icemaker to the top of the ice/beverage machine, so that as ice is made it drops directly from the icemaker into the ice bin. However, the particular icemaker selected can be from one of several manufacturers having various and differently dimensioned footprints that may or may not accommodate direct mounting of the icemaker on top of a given ice/beverage dispensing machine.

Accordingly, it would be desirable to have a single mounting kit or system that is easily adaptable to permit quick and efficient adaptation of one of a variety of differently dimensioned machines to a particular standard base machine.

SUMMARY OF THE INVENTION

The present invention concerns an adapter device for accommodating mounting of a variety of differently dimensioned machines on top of a standard sized base machine. In the illustrated embodiments, an ice and beverage dispensing machine forms a standard base unit and includes an ice retaining bin having a top opening defined by a perimeter edge. The invention includes a cover that fits over the bin top opening while being supported on the perimeter edge of the bin. The cover includes an ice drop opening over which an icemaker is mounted. The cover also has a first bar receiving channel adjacent to and extending along one end of the ice drop opening and a plurality of second bar receiving channels adjacent to and extending along an opposite end of the ice drop opening. A first rigid bar is placed in the first channel and a second rigid bar is placed in a selected one of the second plurality of channels, the selection being made in accordance with the width of the base of the icemaker, so that the two bars span the width of the ice bin and are spaced by a distance that provides optimum support for the base of icemaker. The ice retaining bin perimeter edge advantageously includes notches positioned in accordance with and for receiving opposite lower ends of the bar receiving channels to provide for better retention of the cover on top of the ice bin. In an alternate embodiment, a pair of rigid bars spans the ice bin opening and opposite ends of the bars are placed directly into the notches formed in the perimeter edge of the bin opening. A cover is then placed on top of the ice/beverage dispensing machine and bars, after which the icemaker is secured to the cover above the ice drop opening and bars.

DETAILED DESCRIPTION

Figure 1:
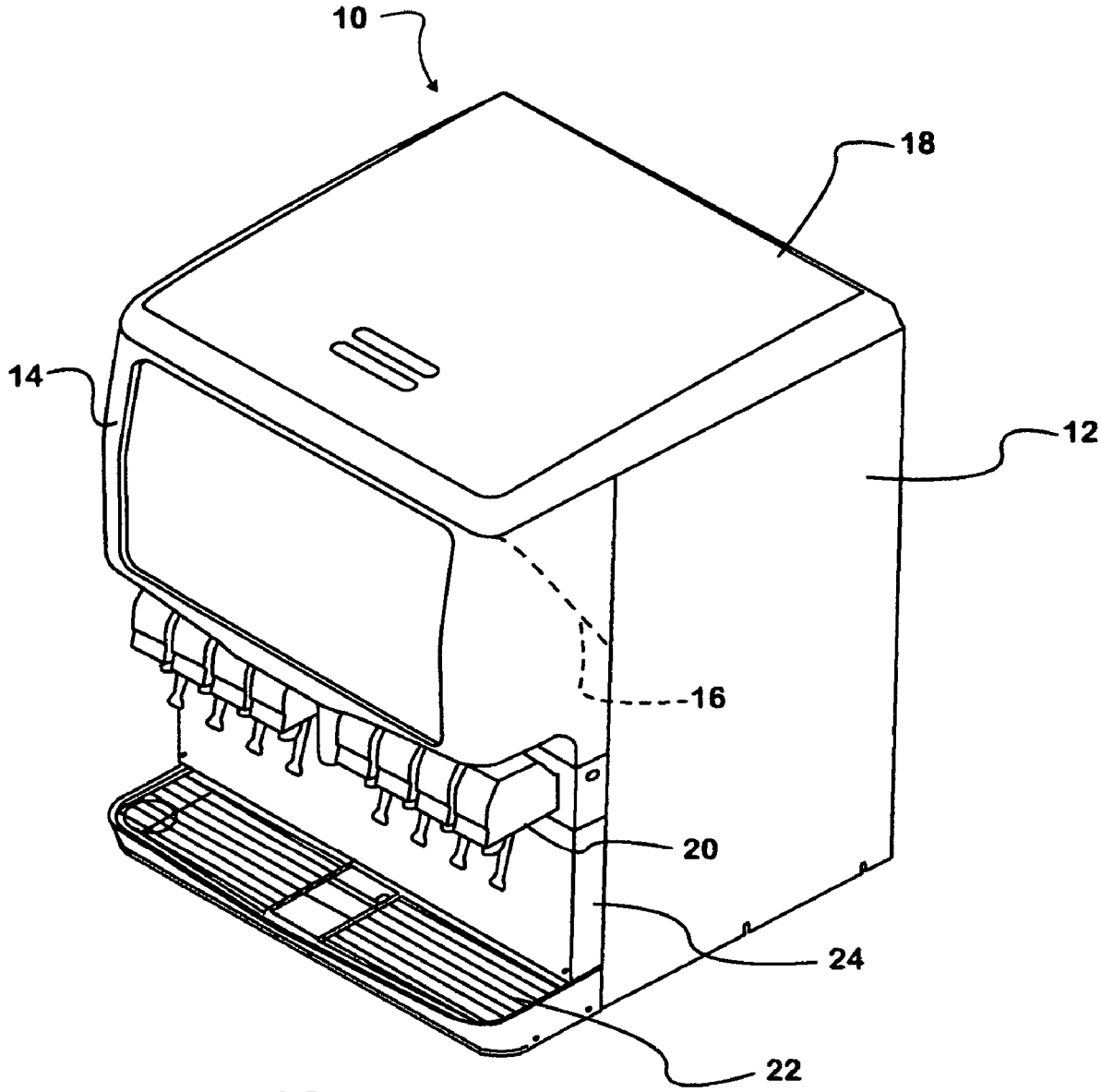
FIG. 1 shows a perspective view of a combination ice and beverage dispenser as is known in the prior art.

An ice and beverage dispensing machine is seen in FIG. 1 and generally referred to by the numeral 10. As is known, the dispenser includes an outer housing 12, a merchandising cover 14, an ice retaining hopper or bin 16 and a removable ice bin cover 18. As is also known, the dispenser includes a plurality of beverage dispensing valves 20, a drip tray 22 and splash panel 24. The bin 16 is located within the outer housing 12 and includes a top ice filling open end 27 defined by a perimeter ice bin edge 28.

Figure 2:
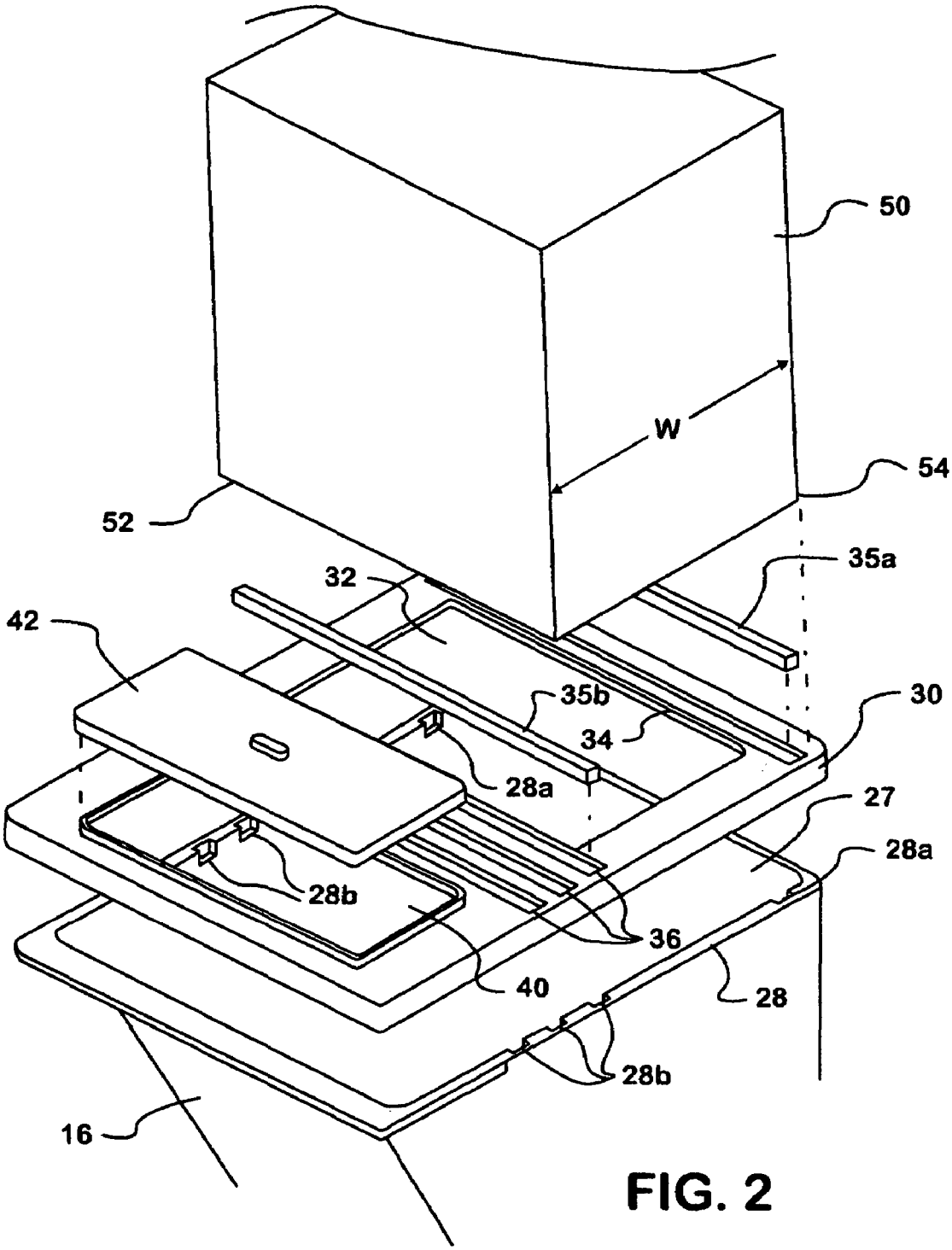
FIG. 2 shows an exploded view of an embodiment of the adapter device of the present invention.
Figure 3:
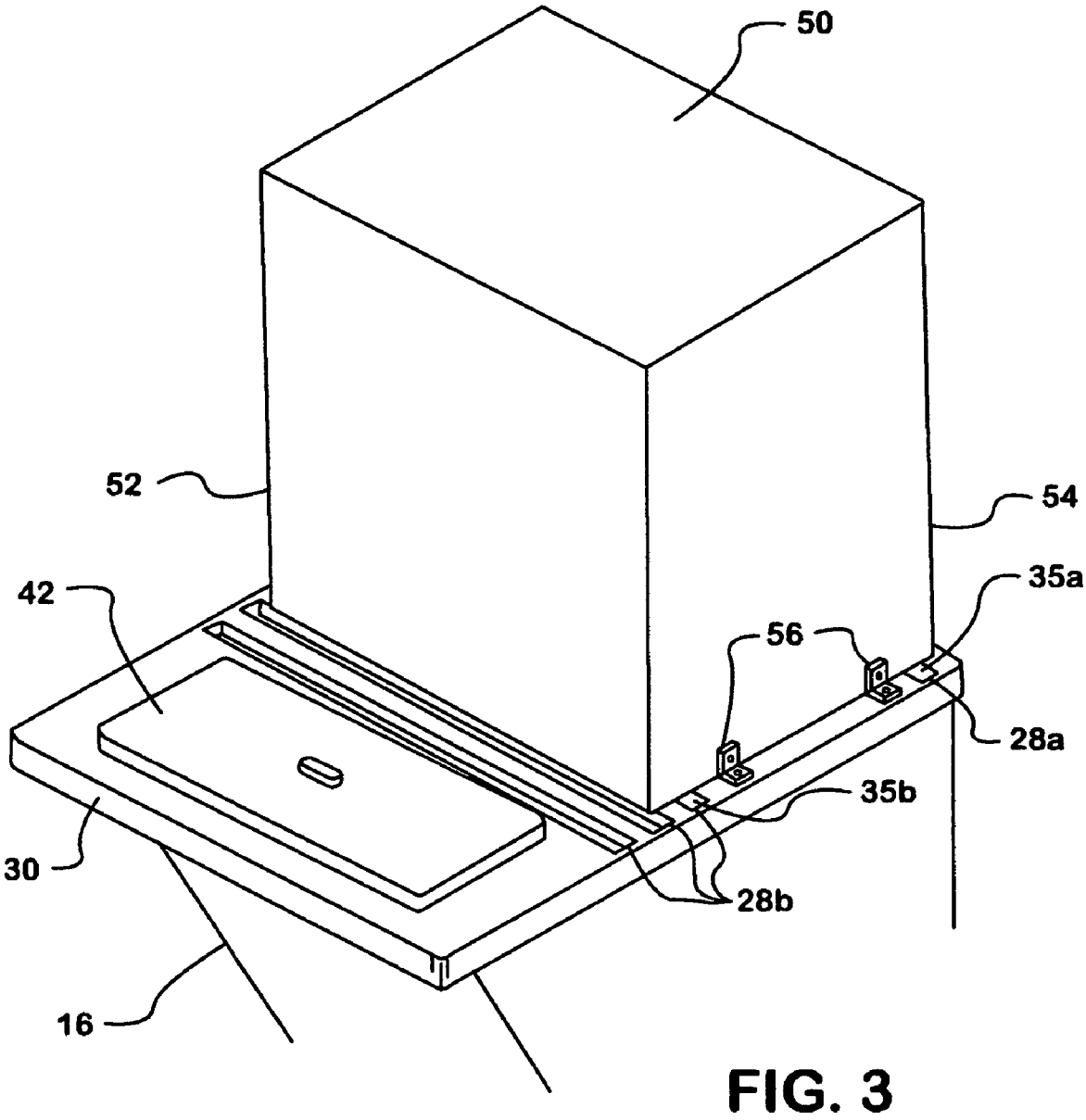
FIG. 3 shows a perspective view of the embodiment of FIG. 2.

As seen in FIGS. 2 and 3, the machine mounting adapter of the invention includes a specially configured top cover 30 that is used in place of the standard bin cover 18. The cover 30 includes an ice drop opening 32 and a rearward bar receiving channel or groove 34 that is recessed into the top surface of the cover and extends generally between opposite sides of the cover and adjacent to and along a rear end or edge of the ice drop opening for receiving therein a rearward rigid metal bar 35*a*. The cover 30 also includes a plurality of spaced and parallel forward bar receiving channels or grooves 36 that are recessed into the top surface of the cover and extend generally between opposite sides of the cover and adjacent to and along a front end or edge of the ice drop opening 32 for receiving a forward rigid metal bar 35*b* in a selected one of the channels 36. In addition, the cover 30 has an ice filling hole or opening 40 over which a removable separate cover 42 extends. When the cover 30 is placed on top of the ice bin 16, a first pair of rearward notches 28*a* formed on opposite sides of the ice bin perimeter edge 28 are located to correspond with and receive opposite lower ends of the rearward channel 34 and a plurality of forward paired notches 28*b* formed on opposite sides of the ice bin perimeter edge are located to correspond with and receive opposite lower ends of the forward channels 36.

In use of the machine mounting adapter of the invention, the cover 30 replaces the standard cover 18, the rearward rigid bar 35*a* is placed in the rearward cover channel 34 and the forward rigid bar 35*b* is placed in a selected one of the forward cover channels 36. The particular forward channel 36 into which the forward bar 35*b* is placed is determined on the basis of the front to back width W of the base or footprint of an icemaker 50 that is to be supported on top of the cover 30 when the cover is placed on the perimeter edge 28 of the ice/beverage dispenser 10. More specifically, the forward channel 36 that receives the forward bar 35*b* is selected so that when the icemaker 50 is mounted on top of the cover 30 of the ice/beverage dispenser, the rearward and forward rigid bars 35*a-b* will be spaced apart a distance such that with the rearward channel bar 35*a* located generally directly beneath and extending along a rear end 54 of the icemaker 50, the forward bar 35*b* will be located generally directly beneath and extend along a front end 52 of the icemaker. The forward and rearward bars 35*a-b* will then be positioned to provide a strong and stable support for the weight of the icemaker on the ice retaining bin 16 of the ice/beverage dispenser 10. Thus, by virtue of providing the plurality of spaced and parallel channels 36, the spacing between the forward and rearward bars 35*a-b* can be selectively controlled such that a wide variety of differently sized icemakers can be accommodated and securely mounted on top of the ice/beverage dispenser, simply by appropriate selection of the forward channel 36 into which to place the forward bar 35*b*. It is to be appreciated that with the icemaker 50 mounted on top of the ice/beverage dispenser, the cover 42 is removable to expose the hole 40 and provide a convenient means for manually filling the ice bin 16 should the icemaker fail for any reason. Once the icemaker is in position on the cover 30, it can be secured to the cover by any suitable attachment means, such as by use of simple L-shaped angle brackets 56 and appropriate screw type securing fasteners.

Figure 4:
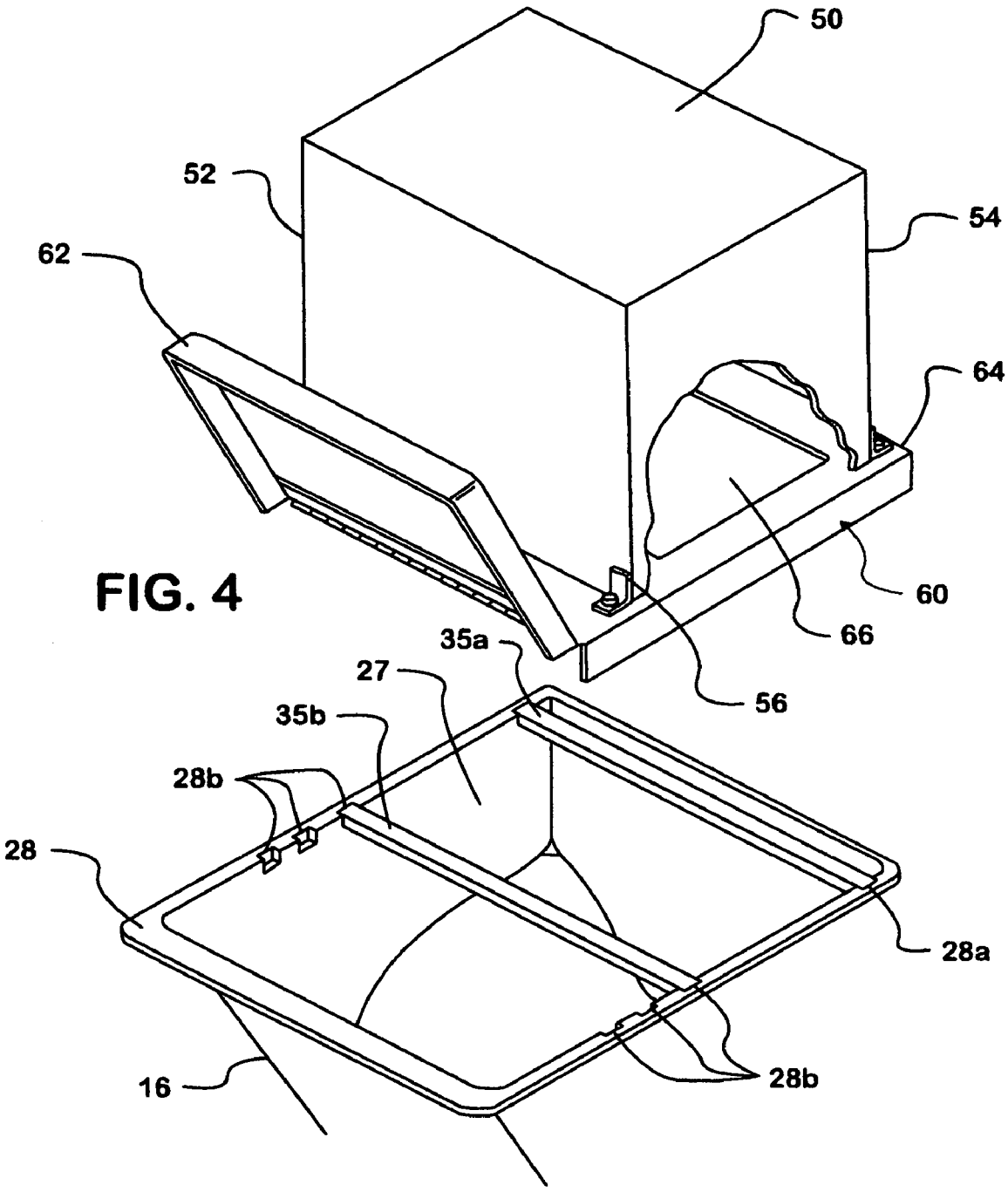
FIG. 4 shows an exploded view of a further embodiment of the adapter device of the present invention.
Figure 5:
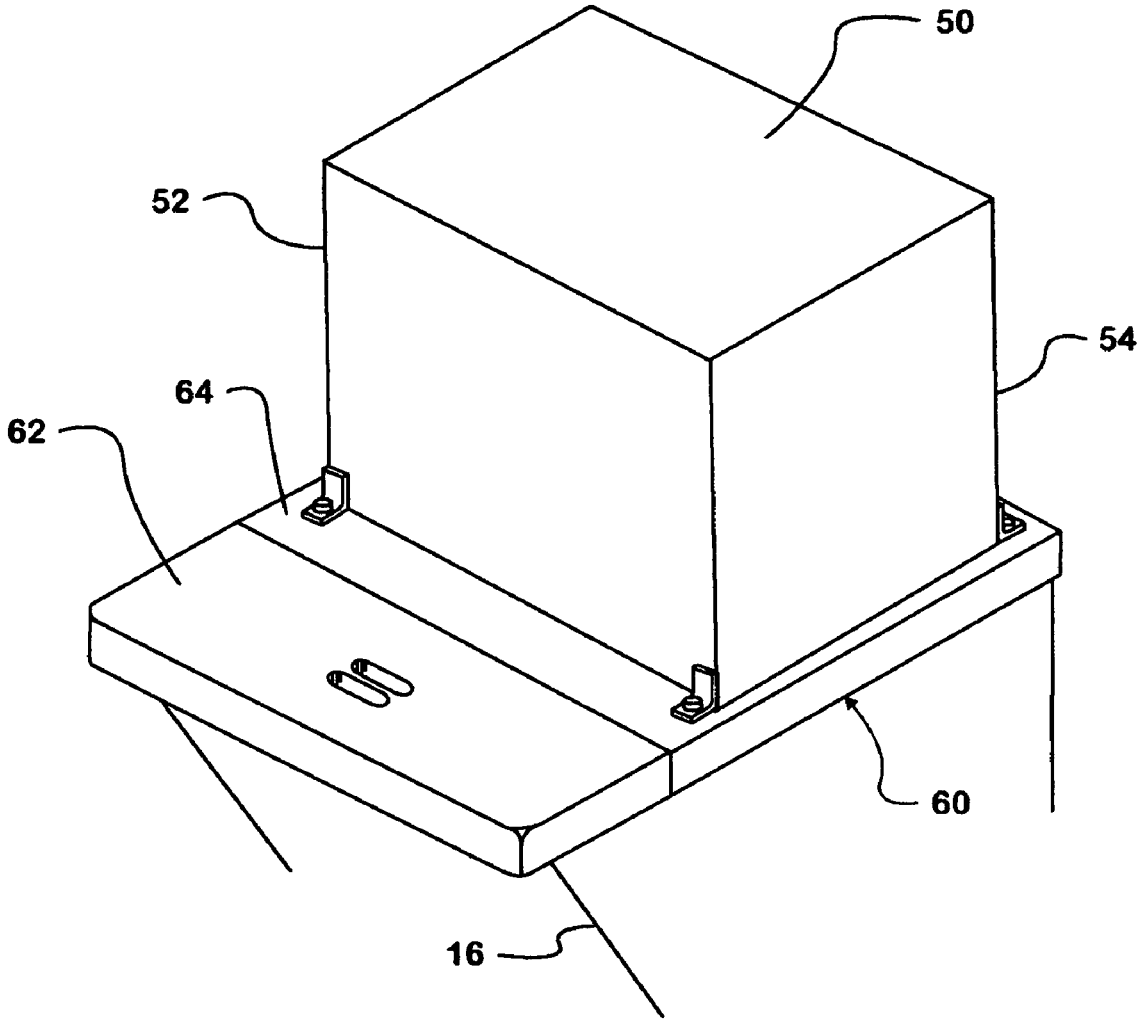
FIG. 5 shows a perspective view of the embodiment of FIG. 4.

An alternate embodiment of machine mounting adapter of the invention is seen in FIGS. 4 and 5 and includes a specially configured cover 60 for use in place of the standard cover 18. The cover 60 has a hinged front door 62 and a rear portion 64 with an ice drop hole 66 therethrough. In this embodiment, the rearward and forward bars 35*a-b* are not received in channels recessed into the top of the cover 60. Instead, the rigid metal bars 35*a-b* extend across the ice bin perimeter edge 28, with opposite ends of the rearward bar 35*a* being received directly in the rearward notch pair 28*a* and opposite ends of the forward bar 35*b* being received directly in a selected pair of the plurality of forward notch pairs 28*b*. The cover 60, when supported in the ice retaining bin perimeter edge 28, then extends over the bars 35*a-b*. This embodiment works much the same as was described above for the embodiment of FIGS. 2 and 3, such that the notch pair 28*b* that receives the forward bar 35*b* is selected in accordance with the front to back width of a footprint of an icemaker 50 that is to be mounted on top of the cover 60. The hinged access hatch or door 62 provides a means for permitting manual filling of the ice bin 16.

While embodiments of the invention have been described in detail, various modifications and other embodiments thereof may be devised by one skilled in the art without departing from the spirit and scope of the invention, as defined in the appended claims.

What is claimed is:

1. A machine mounting adapter for accommodating mounting of individual ones of a plurality of differently sized ice machines on top of an ice dispensing machine, comprising:

a cover for being supported on a top perimeter edge of and for extending over and across a top opening to an ice retaining bin of the ice dispensing machine, said cover having an ice drop opening; and two parallel and relatively rigid bars for extending from side to side across the opening to the ice retaining bin, said cover and bars for being supported on the top perimeter edge of the ice retaining bin with said bars in front to back spaced relationship such that, when an ice machine is mounted on top of the ice dispensing machine, said two bars are located generally beneath and along associated front and rear ends of the ice machine to securely support the ice machine on top of the ice dispenser, said cover ice drop opening accommodating passage of ice from the ice machine into the ice retaining bin.

2. An adapter as in claim 1, wherein said bars are received in channels recessed in said cover and said cover is for being supported on the perimeter edge of the ice retaining bin.

3. An adapter as in claim 2, wherein lower opposite ends of said channels are for being received in notches formed in the perimeter edge of the ice retaining bin.

4. An adapter as in claim 1, wherein said bars are for being received in notches formed in the perimeter edge of the ice retaining bin and said cover is for being positioned on the perimeter edge of the ice retaining bin and over said bars.

5. An adapter as in claim 1, wherein said cover includes a separate ice filling hole accommodating manual filling of the ice retaining bin.

6. A machine mounting adapter for accommodating mounting of individual ones of a plurality of differently dimensioned ice machines on top of an ice dispensing machine, comprising:

a cover for being supported on a top perimeter edge of and for extending over and across a top opening to an ice retaining bin of the ice dispensing machine, said cover having an ice drop opening, a rear bar receiving channel located rearward from a rear side of said ice drop opening and extending substantially across said cover and a plurality of parallel and spaced front bar receiving channels located forward from a front side of said ice drop opening and extending substantially across said cover, wherein opposite ends of said rear and front bar receiving channels are for being received in associated pairs of notches in the top perimeter edge of the ice retaining bin when said cover is supported on the top perimeter edge; and two rigid bars, one for being received in said rear bar receiving channel and the other for being received in a selected one of said plurality of front bar receiving channels, said selected one of said plurality of front bar receiving channels being determined in accordance with the width of a base of the ice machine being mounted on top of the ice dispenser, such that the spacing between said two bars will be substantially equal to the front to back width of the ice machine base, said cover ice drop opening accommodating passage of ice from the ice machine into the ice retaining bin.

7. An adapter as in claim 6, wherein said cover includes a separate ice filling hole for accommodating manual filling of the ice retaining bin.

8. An adapter as in claim 7, wherein said cover further includes a separate removable cover for placement across said separate ice filling hole.

9. An adapter as in claim 6, wherein said front and rear bar receiving channels are in parallel relationship.

10. An adapter as in claim 6, wherein said front and rear ends of said ice drop opening are generally straight and parallel and said front and rear bar receiving channels extend generally parallel to said front and rear ends of said ice drop opening.

11. A machine adapter for accommodating mounting of individual ones of a plurality of differently dimensioned ice machines on top of an ice dispensing machine, comprising:

two relatively rigid elongate bars for being supported on a top perimeter edge of and for extending from side to side across a top opening to an ice retaining bin of the ice dispensing; and a cover for being supported on the top perimeter edge of and for extending over and across the top opening to the ice retaining bin and over and across the two bars for accommodating mounting of an ice machine on said cover, said cover having an ice drop opening and opposite ends of said two bars for being placed in associated selected pairs of notches in the top perimeter edge of the ice retaining bin, wherein the associated pairs of notches are selected to control the spacing between the bars so that the bars will be located generally beneath front and rear ends of a base of the ice machine when the ice machine is mounted on the cover, said cover ice drop opening accommodating passage of ice from the ice machine into the ice retaining bin.

12. An adapter as in claim 11, wherein said two relatively rigid bars are for being supported on the top perimeter edge of the ice retaining bin in generally parallel relationship.

13. An adapter as in claim 11, wherein front and rear ends of said ice drop opening are generally straight and parallel and said bars extend generally parallel to said front and rear ends of said ice drop opening when said cover and bars are being supported on the top perimeter edge of the ice retaining bin.

14. A device for mounting a plurality of differently sized ice machines on top of an ice dispensing machine, comprising:

a cover for being placed on a top perimeter edge of an ice retaining bin of the ice dispensing machine, said cover having an ice drop opening with back and front edges, a rearward bar receiving channel extending in and along said cover rearward from said ice drop opening back edge, and a plurality of forward spaced and parallel bar receiving channels extending in and along said cover forward from said ice drop opening front edge, the ice bin top perimeter edge having pairs of notches therein corresponding in location to and for receiving therein opposite ends of said forward and rearward bar receiving channels; and rearward and forward rigid bars, said rearward bar being placed in said cover rearward channel and said forward bar being placed in a one of the plurality of cover forward channels selected so that said rearward and forward bars will be spaced from each other by a distance such that they generally underlie and extend along respective rearward and forward ends of a base of an ice machine supported on top of said cover, said cover ice drop opening accommodating passage of ice from the ice machine into the ice retaining bin.

15. A device as in claim 14, said cover also including a secondary hole for permitting manual filling of the ice bin with ice and including a removable secondary cover for the secondary hole.

16. A device as in claim 14, wherein said rearward and forward bar receiving channels are parallel.

17. A device as in claim 14, wherein said rearward and forward bar receiving channels are parallel and said ice drop opening front and back edges are generally parallel to each other and to said rearward and forward bar receiving channels.

* * * * *